US007806260B2

(12) United States Patent
Chun

(10) Patent No.: US 7,806,260 B2
(45) Date of Patent: Oct. 5, 2010

(54) DISPLAY APPARATUS FOR A PORTABLE ELECTRONIC DEVICE

(75) Inventor: Chen-Huang Chun, Taipei (TW)

(73) Assignee: Inventec Appliances Corp., Taipei, Taiwan (CN)

( * ) Notice: Subject to any disclaimer, the term of this patent is extended or adjusted under 35 U.S.C. 154(b) by 644 days.

(21) Appl. No.: 11/646,310

(22) Filed: Dec. 28, 2006

(65) Prior Publication Data

US 2007/0151899 A1 Jul. 5, 2007

(30) Foreign Application Priority Data

Dec. 30, 2005 (TW) ..... 94223215 U

(51) Int. Cl.
*B65D 85/00* (2006.01)
*B65D 25/54* (2006.01)

(52) U.S. Cl. ..... 206/320; 206/775; 206/488; 206/822

(58) Field of Classification Search ..... 206/457, 206/822, 486, 488, 775, 320, 765, 769, 588, 206/592

See application file for complete search history.

(56) References Cited

U.S. PATENT DOCUMENTS

| | | | | |
|---|---|---|---|---|
| 2,554,516 | A * | 5/1951 | Anthony | 446/325 |
| 6,170,663 | B1 * | 1/2001 | Glassman | 206/461 |
| 6,622,867 | B2 * | 9/2003 | Menceles | 206/771 |

* cited by examiner

*Primary Examiner*—J. Gregory Pickett
(74) *Attorney, Agent, or Firm*—Birch, Stewart, Kolasch & Birch, LLP

(57) ABSTRACT

A display apparatus for displaying a portable electronic device comprises a curved shell, a gravity base, a seat and a transparent cover that covers the curved shell and the seat. The gravity base is formed on the bottom of the curved shell. The seat is lodged in the curved shell and the seat has interior space having a shape matching the predetermined shape of a portable electronic device. The assembled gravity base and the curved shell are integrally formed as a tumbler structure for keeping balance while facing external forces.

12 Claims, 4 Drawing Sheets

DISPLAY APPARATUS FOR A PORTABLE ELECTRONIC DEVICE

BACKGROUND OF THE INVENTION (1) Field of the Invention

The present relates to a display apparatus, especially to a display apparatus for a portable electronic device.

(2) Description of the Prior Art

Nowadays, portable electronic devices are popular in their diversity functions and also in their diversity appearances.

In mobile phone exhibitions, there are various kinds of display apparatuses for exhibiting mobile phones in the marketplace. Please refer to FIG. 1, which shows a general display apparatus of prior art. The display apparatus 1 of FIG. 1 comprises an L-shaped supporter 11, a show case 12 and two protective plates 13. The show case 12 is fixed on the L-shaped supporter 11 to anchor a mobile phone 2. The two protective plates 13 are just disposed outside the two opposite sides of the show case 12 to prohibit possible sideward displacements of the mobile phone 2 at a horizontal direction.

However, the display apparatus 1 has following two disadvantages. Firstly, the structure of the display apparatus 1 is unable to protect the mobile phone entirely, and the mobile phone 1 is easy to slide off from the open side (herein, the front side) of the display apparatus 1. Secondly, the design of the display apparatus 1 is unable to display all aspects of the mobile phones 2. From FIG. 1, it is clear that only the front aspect and the top aspect of the mobile phone 2 can be shown. Moreover, the open design of the display apparatus 1 risks the mobile phone 2 being stolen in a public exhibition. But if the display apparatus 1 is placed within a locked glass frame, it would be hard to be accessed by prospective buyers. Therefore, a display apparatus that can show the mobile phone in all aspects and can be safe from theft is worthy to be expected.

SUMMARY OF THE INVENTION

An object of the present invention is to provide a display apparatus of a portable electronic device.

Another object of the present invention is to provide a display apparatus which may protect the displayed electronic device from being slid off by external forces.

Another object of the present invention is to provide a display apparatus which may display all aspects of the displayed electronic device.

The display apparatus comprises a curved shell, a gravity base, at least a seat and a transparent cover that covers the curved shell and the at least a seat.

The gravity base is formed on the bottom of the curved shell. The seat could be lodged in the curved shell and the seat has interior space having a shape matching the predetermined shape of a portable electronic device.

The assembled gravity base and the curved shell are integrally formed as a tumbler structure so as to be capable of keeping balance while facing external forces.

To sum up, the display apparatus of the present invention provides not only a safe mode for displaying portable electronic devices but also an efficiency mode for displaying electronic devices with all aspects.

BRIEF DESCRIPTION OF THE DRAWINGS

Other features and advantages of this invention will become more apparent in the following detailed description of the preferred embodiments of this invention, with reference to the accompanying drawings, in which.

DESCRIPTION OF THE PREFERRED EMBODIMENT

The present invention discloses a display apparatus for displaying a portable electronic device. The display apparatus comprises a curved shell, a gravity base, a seat and a transparent cover that covers the curved shell and the seat. The gravity base is formed on the bottom of the curved shell. The seat could be lodged in the curved shell and the seat has interior space having a shape matching the predetermined shape of a portable electronic device. The assembled gravity base and the curved shell are integrally formed as a tumbler structure (the tumbler structure is known not to be easily knocked down by external forces. The tumbler structure will waver for a period of time and then keep balance after being hit by external forces. Therefore, the portable electronic device within the display apparatus will waver with the display apparatus until keeping balance. The worry that an electronic device may slide off a display apparatus will never happen again.

Figure 1:
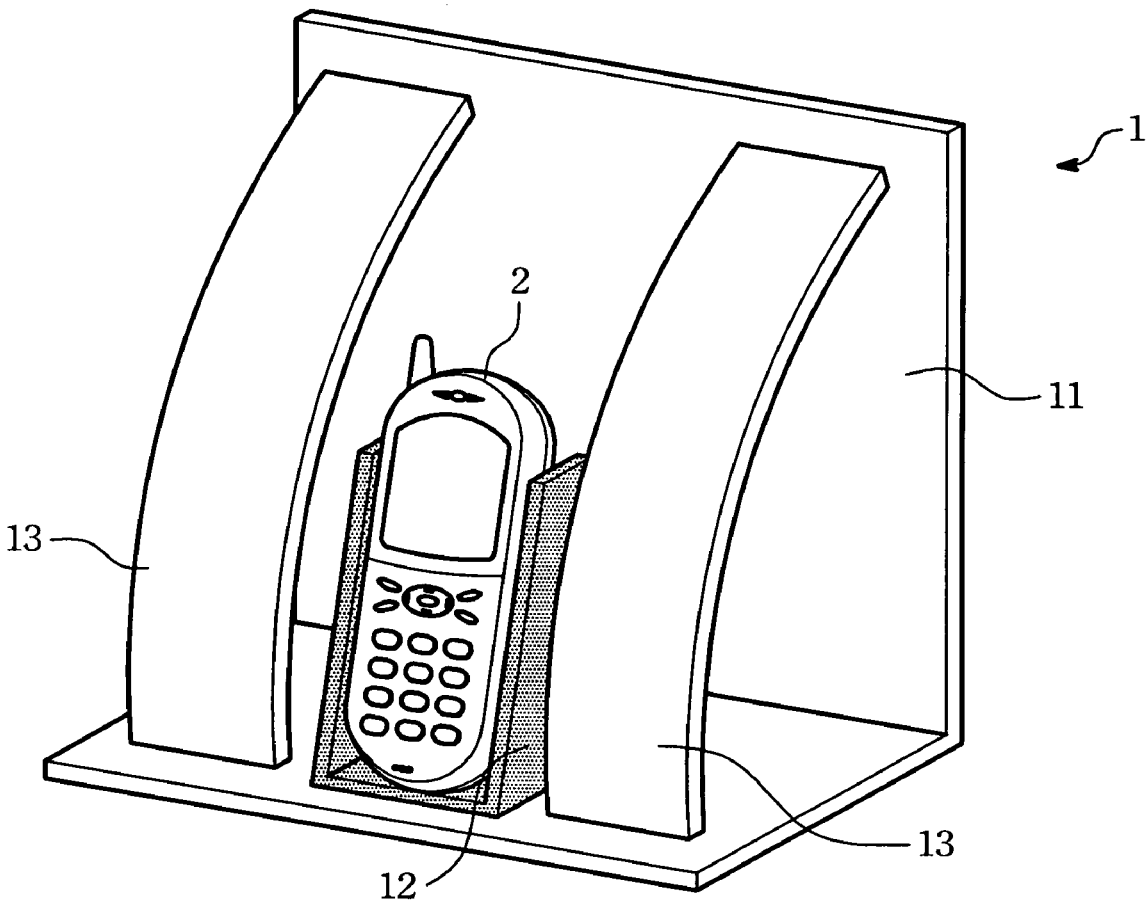
FIG. 1 (Prior Art)
FIG. 1 shows a conventional display apparatus of prior art.
Figure 2:
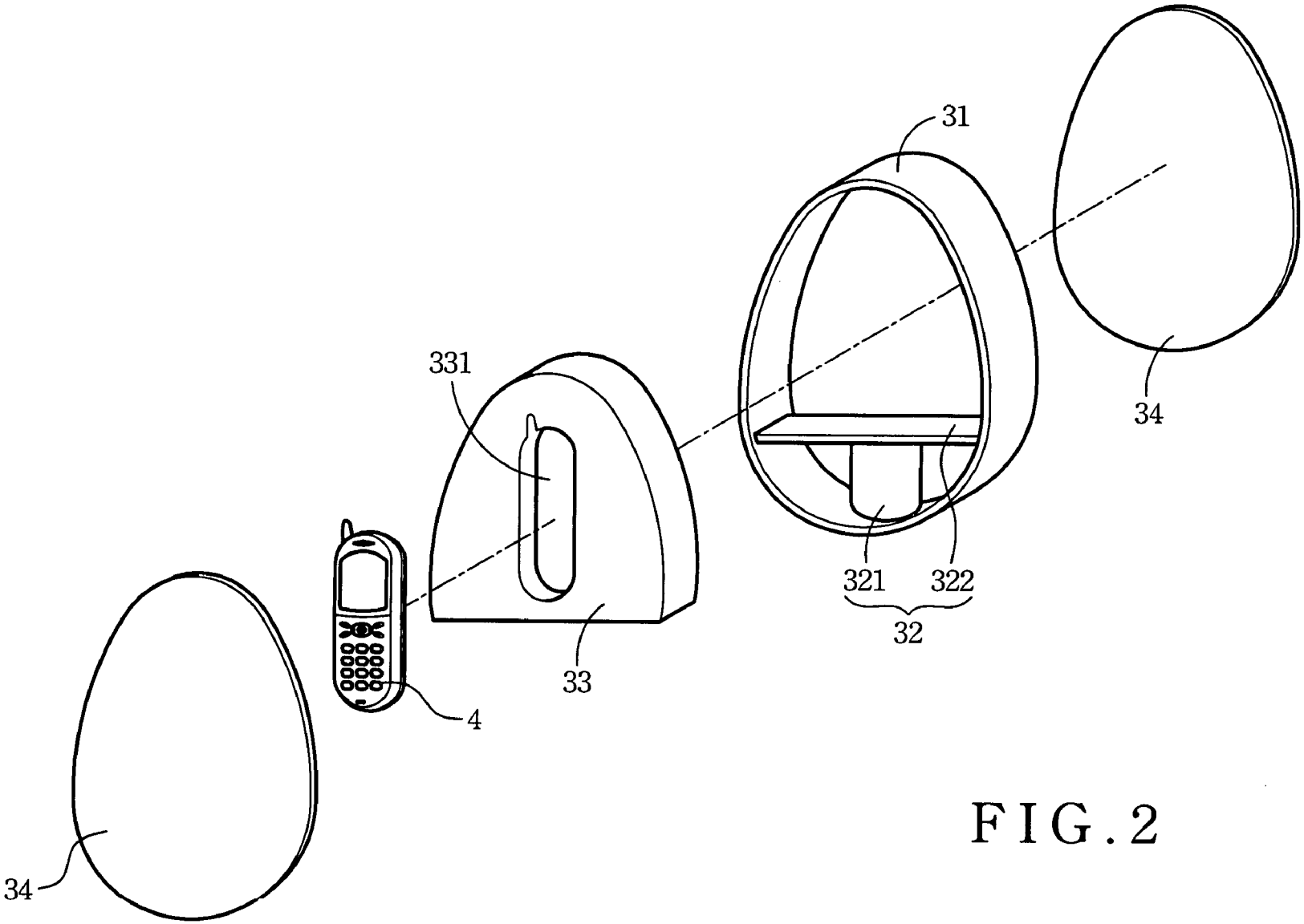
FIG. 2 is a dismantled view of an embodiment of a display apparatus according to the present invention.

Please refer to FIG. 2, which is a dismantled view of a preferred display apparatus 3 according to the present invention. The portable electronic device displayed by the display apparatus 3 is a mobile phone 4. The display apparatus 3 comprises a curved shell 31, a gravity base 32, a seat 33 and two transparent covers 34.

The curved shell 31 herein is an egg-shaped housing having two openings on two opposite sides, respectively. The two transparent covers 34 may be assembled with the curved shell 31 to cover the respective openings of the curved shell 31. The seat 33 has interior space 331 having a shape matching the predetermined shape of the mobile phone 4. Hence, the mobile phone 4 may be contained in the space 331 firmly. The shape of the seat 33 also matches the internal shape of the curved shell 31, and hence the seat 33 may lodge in the curved shell 31 firmly. The gravity base 32 is composed of a gravity core 321 and a supporter plate 322.

In the present invention, the assembled display apparatus 3 is formed as a tumbler structure that has advantages of not being easily knocked down by external forces. The tumbler structure will waver for a period of time and then keep balance again after being hit by external forces. Therefore, the portable electronic device 4 within the display apparatus 3 will waver with the display apparatus 3 until keeping balance again.

Figure 3:
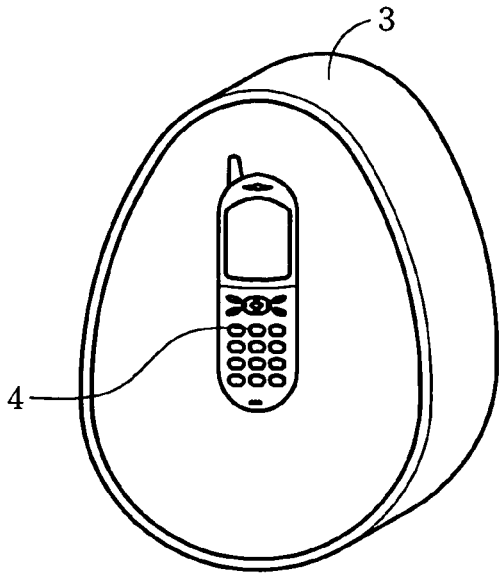
FIG. 3 shows a state that a mobile phone is displayed by the display apparatus.

Please refer to FIG. 3, which shows a diagram of the mobile phone 4 displayed by the display apparatus 3. In the preferred embodiment, the material made of the curved shell 31 is a transparent material. Therefore, through the transparent display apparatus 3, all aspects of the mobile phone 4 may be displayed. Hence, the mobile phone 4 can be easily seen by the visitors crowded around the display apparatus 3.

The primary object of the present invention is to provide a display apparatus having a tumbler-like structure, which has a centralized lower gravity centering on the bottom thereof for being able to keep balance easily. The material of the display apparatus is not restricted herein in the present invention, and can be any of common plastic materials such as acrylic plastic, poly carbonate (PC), poly-vinyl chloride (PVC) or any transparent resin material.

Figure 4:
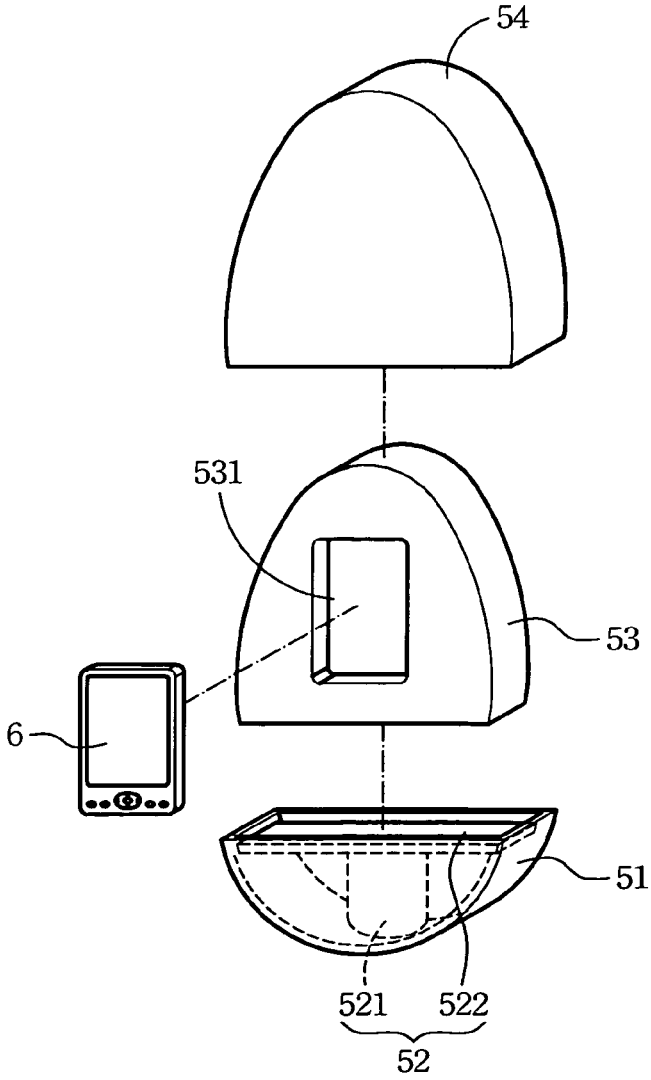
FIG. 4 is a dismantled view of another embodiment of the display apparatus according to the present invention.

Please refer to FIG. 4, which is a dismantled view of another display apparatus according to the present invention. The portable electronic device 6 displayed by the display apparatus 5 is a personal digital assistance (PDA) 6. The display apparatus 5 comprises a curved shell 51, a gravity base 52, a seat 53 and a transparent curved cover 54.

In this embodiment, the curved shell 51 is a hemispherical-like shell having an opening at its upper part. The curved shell 51 is covered with the transparent curved cover 54 so as to form integrally as an egg-shaped structure.

Figure 5A:
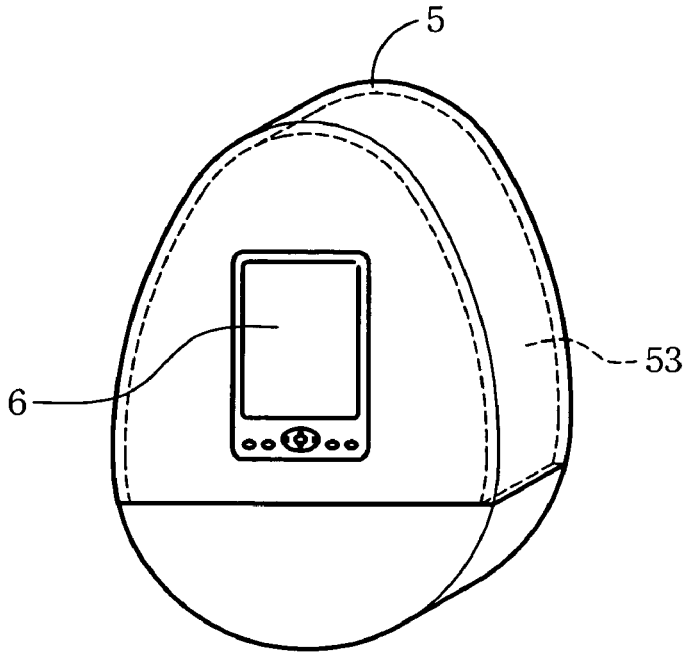
FIG. 5A illustrates how the display apparatus collocates with a seat for displaying a mobile phone.

The seat 53 has interior space 531 having a shape matching the predetermined shape of the PDA 6, so that the PDA 6 may be jammed into the space 531 firmly. The seat 53 has a predetermined shape matching the curved shell 31 so that may be placed into the curved shell 31 tightly. The gravity base 52 is composed of a gravity core 521 and a supporter plate 522. The existence of the gravity base 52 makes the assembled display apparatus 5 a tumbler structure that has the advantage of not easily to be knocked down by external forces. Upon such an arrangement, the display apparatus can provide a sealed space to accommodate the PDA 6 and can avoid the PDA 6 being slid off from the display apparatus 5 by external forces (shown in FIG. 5A).

Figure 5B:
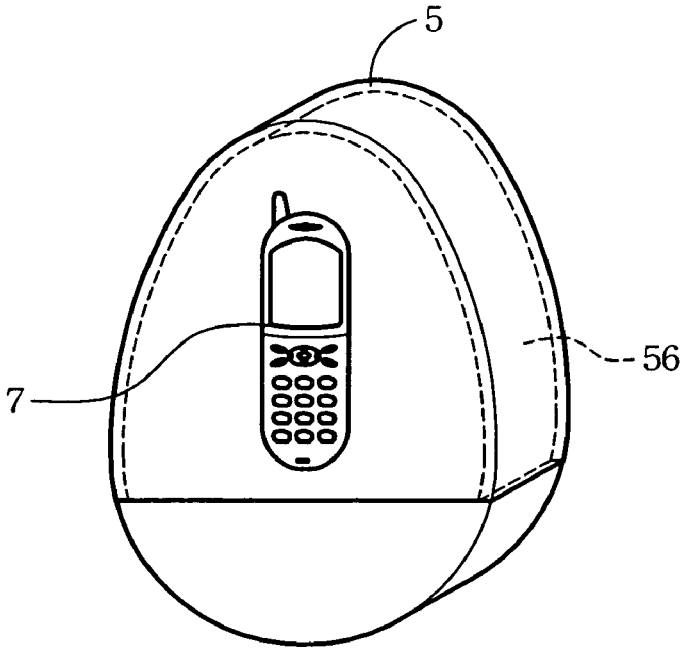
FIG. 5B illustrates the diagram of the display apparatus collocating with another seat for displaying a mobile phone.

The seat 53 of the present invention is a device which may be replaced by other seats having interior space matching other kinds of portable electronic devices. Please refer to FIG. 5B, which illustrates a diagram that the display apparatus 5 collocates with a seat 56 for displaying a mobile phone 7.

To sum up, the display apparatus of the present invention provides not only a safe mode for displaying portable electronic devices but also an efficiency mode for displaying electronic devices in all aspects.

While the present invention has been particularly shown and described with reference to such preferred embodiments, it will be understood by those skilled in the art that various changes in form and detail may be without departing from the spirit and scope of the present invention.

What is claimed is:

1. A display apparatus for a mobile phone, comprising:

a curved shell having two opposite openings on two opposite sides thereof;

a gravity base formed on a bottom of the curved shell for providing a stable force;

at least a seat lodged in the curved shell for accommodating the mobile phone having a predetermined shape, wherein said at least a seat comprises a space having a shape that matches the predetermined shape of the mobile phone; and a transparent cover for covering the curved shell and the at least a seat;

wherein the assembled gravity base and the curved shell are integrally formed as a tumbler structure.

2. The display apparatus of claim 1, wherein the curved shell is an egg-shaped housing.

3. The display apparatus of claim 2, wherein the curved shell is covered with two transparent covers to cover the two opposite openings respectively.

4. The display apparatus of claim 1, wherein the curved shell is a hemispheric-like shell having an opening at an upper part of the curved shell.

5. The display apparatus of claim 4, wherein the curved shell is covered with a transparent cover to be an egg-shaped structure.

6. The display apparatus of claim 1, wherein the curved shell is made of a transparent material.

7. The display apparatus of claim 1, wherein the display apparatus is made of a transparent material in its entirety.

8. The display apparatus of claim 1, wherein the display apparatus is made of a material selected from a group of acrylic, poly carbonate (PC), poly-vinyl chloride (PVC) and a resin material in its entirety.

9. The display apparatus of claim 1, wherein the curved shell contains a cavity and the gravity base is integrally formed inside the cavity.

10. The display apparatus of claim 1, wherein the gravity base comprises a gravity core and a supporting plate.

11. The display apparatus of claim 10, wherein the seat is directly disposed on the supporting plate.

12. A display apparatus for a personal digital assistant (PDA), comprising:

a curved shell having two opposite openings on two opposite sides thereof;

a gravity base formed on a bottom of the curved shell for providing a stable force;

at least a seat lodged in the curved shell for accommodating the personal digital assistant (PDA) having a predetermined shape, wherein said at least a seat comprises a space having a shape that matches the predetermined shape of the personal digital assistant (PDA); and a transparent cover for covering the curved shell and the at least a seat;

wherein the assembled gravity base and the curved shell are integrally formed as a tumbler structure.

* * * * *